US009999308B1

(12) United States Patent
Bernick

(10) Patent No.: US 9,999,308 B1
(45) Date of Patent: Jun. 19, 2018

(54) SYSTEM FOR SECURING BEDCLOTHES TO A MATTRESS AND METHOD

(71) Applicant: DeBora Rachelle Maki Bernick, Duluth, MN (US)

(72) Inventor: DeBora Rachelle Maki Bernick, Duluth, MN (US)

( * ) Notice: Subject to any disclaimer, the term of this patent is extended or adjusted under 35 U.S.C. 154(b) by 0 days. days.

(21) Appl. No.: 15/874,471

(22) Filed: Jan. 18, 2018

Related U.S. Application Data

(63) Continuation of application No. 15/642,925, filed on Jul. 6, 2017, now Pat. No. 9,918,572.

(51) Int. Cl.
*A47G 9/04* (2006.01)
*A47G 9/02* (2006.01)

(52) U.S. Cl.
CPC ..... *A47G 9/04* (2013.01); *A47G 9/0238* (2013.01)

(58) Field of Classification Search
CPC ..... A47G 9/04
USPC ..... 5/496–500, 494
See application file for complete search history.

(56) References Cited

U.S. PATENT DOCUMENTS 3,350,726 A * 11/1967 Gardner ..... A47C 21/026 5/411
6,185,766 B1 2/2001 Farrugia
9,924,813 B1 * 3/2018 Basten ..... A47G 9/04
2009/0241261 A1 10/2009 Sack

* cited by examiner

*Primary Examiner* — Fredrick C Conley
(74) *Attorney, Agent, or Firm* — Ted Masters

(57) ABSTRACT

A system for securing bedclothes to a mattress includes a bottom sheet which is shaped and dimensioned to fit over the top surface of the mattress. The bottom sheet has four corners which include a first corner and a diagonally opposite second corner, and a third corner and a diagonally opposite fourth corner. The second corner has a second corner aperture, and the fourth corner has a fourth corner aperture. A first strap is shaped and dimensioned to connect the first corner to the second corner. The first strap has a first end which is permanently connected to the first corner, and a second end which is configured to pass through the second corner aperture and fold back and connect to itself. A second strap is shaped and dimensioned to connect the third corner to the fourth corner. The second strap has a first end which is permanently connected to the third corner, and a second end which is configured to pass through the fourth corner aperture and fold back and connect to itself.

9 Claims, 7 Drawing Sheets

Fig. 8
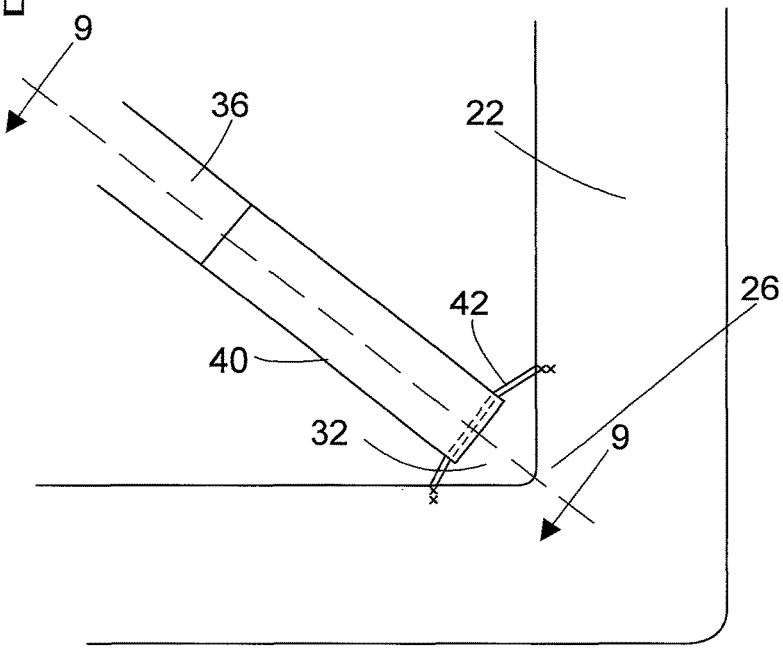
Fig. 9
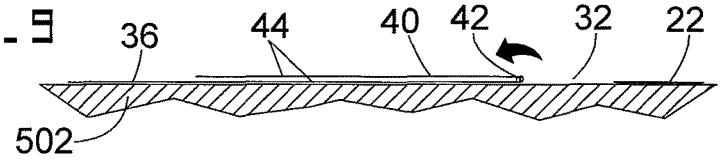
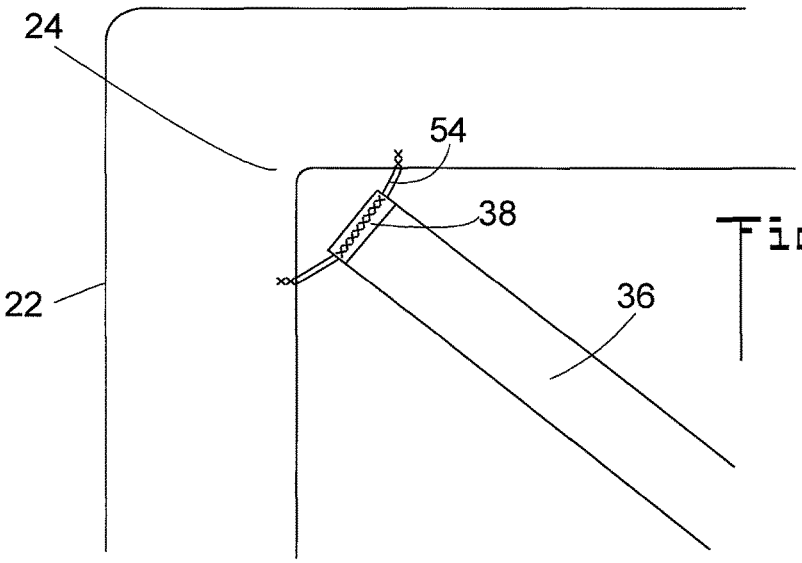
Fig. 10

Fig. 17
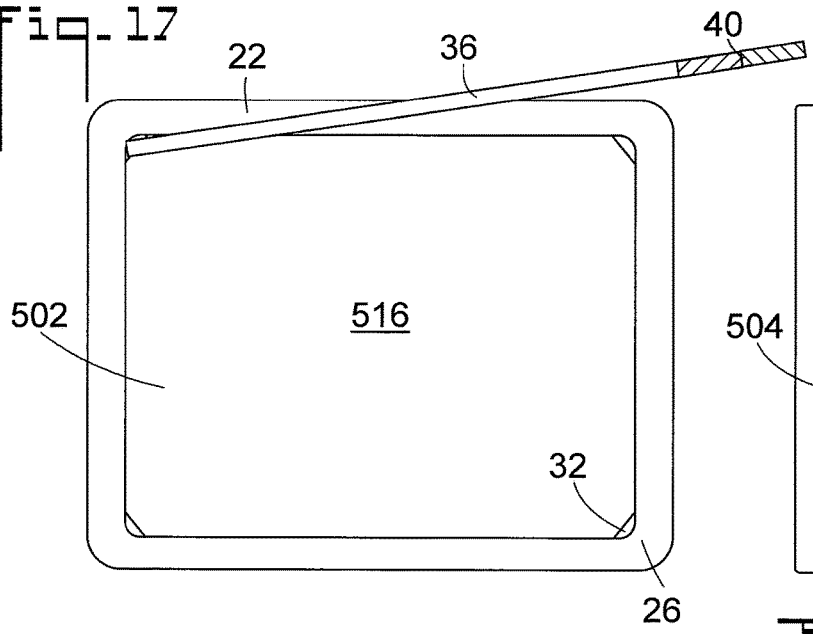
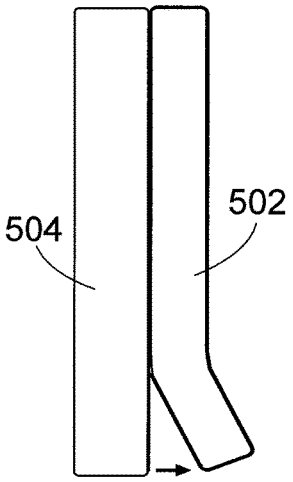
Fig. 18
Fig. 19
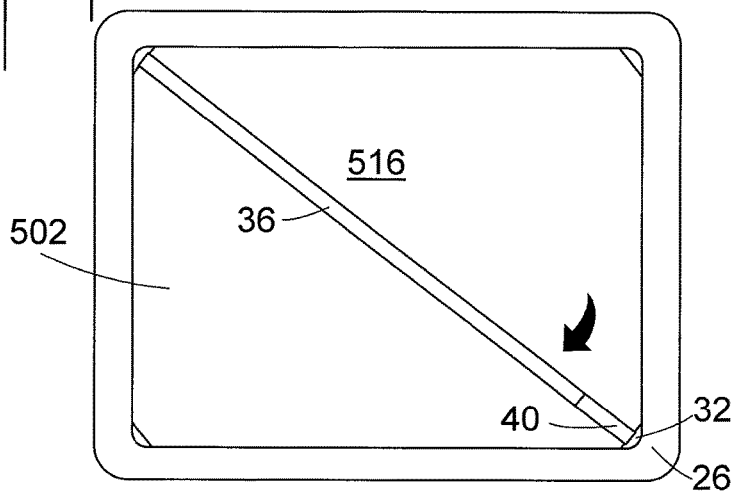

SYSTEM FOR SECURING BEDCLOTHES TO A MATTRESS AND METHOD

CROSS REFERENCE TO RELATED APPLICATION

This application is a continuation of and claims the filing benefit under 35 U.S.C. § 120 of application Ser. No. 15/642,925 filed Jul. 6, 2017, which is hereby incorporated by reference.

TECHNICAL FIELD

The present invention pertains generally to beds and bedclothes, and more particularly to a system and method for securing bedclothes to a mattress.

BACKGROUND OF THE INVENTION

Bedclothes such as sheets are used to cover a mattress of a bed. To keep them in place, the sheets are typically tucked in between the mattress and a box spring upon which the mattress rests. However, when the bed is used, particularly by a restless sleeper, the sheets can loosen or become completely detached.

BRIEF SUMMARY OF THE INVENTION

The present invention is directed to a system for securing bedclothes to a mattress. The system includes a bottom sheet which has first and second straps one end of which are permanently connected to the bottom sheet. The straps are designed to connect to the diagonally opposite corner and thereby prevent the sheet from becoming loosened. In an embodiment, a top sheet is also connectable to the corners of the bottom sheet.

In accordance with an embodiment, a system for securing bedclothes to a mattress having a top surface and an opposite bottom surface includes a bottom sheet which is shaped and dimensioned to fit over the top surface of the mattress, the bottom sheet has four corners which include a first corner and a diagonally opposite second corner, and a third corner and a diagonally opposite fourth corner. The second corner has a second corner aperture, and the fourth corner having a fourth corner aperture. A first strap is shaped and dimensioned to connect the first corner to the second corner. The first strap has a first end which is permanently connected to the first corner, and a second end which is configured to pass through the second corner aperture and fold back and connect to itself. A second strap is shaped and dimensioned to connect the third corner to the fourth corner. The second strap has a first end which is permanently connected to the third corner, and a second end which is configured to pass through the fourth corner aperture and fold back and connect to itself.

In accordance with another embodiment, the second corner aperture and the fourth corner aperture each including a single opening in the bottom sheet.

In accordance with another embodiment, the first corner has a permanently connected first corner strap, and the third corner has a permanently connected third corner strap. The first end of the first strap is permanently connected to the first corner strap, and the first end of the second strap is permanently connected to the third corner strap.

In accordance with another embodiment, the first end of the first strap is sewn to the first corner strap, and the first end of the second strap is sewn to the third corner strap.

In accordance with another embodiment, the first end of the first strap is directly sewn to the first corner of the bottom sheet, and the first end of the second strap being directly sewn to the third corner of the bottom sheet.

In accordance with another embodiment, the bottom sheet is connectable to the mattress so that the bottom sheet covers the top surface of the mattress, and the second corner aperture, the fourth corner aperture, the first strap, and the second strap are all disposed underneath the bottom surface of the mattress.

In accordance with another embodiment, the first corner, the third corner, the second corner aperture, the fourth corner aperture, the first strap, and the second strap all disposed in coplanar relationship underneath the bottom surface of the mattress.

Other embodiments, in addition to the embodiments enumerated above, will become apparent from the following detailed description, taken in conjunction with the accompanying drawings, which illustrate, by way of example, the principles of the system for securing bedclothes to a mattress and method.

BRIEF DESCRIPTION OF THE DRAWINGS

FIG. 8 is an enlarged view of area 8 of FIG. 6;

FIG. 9 is a view along line 9-9 of FIG. 8;

FIG. 10 is an enlarged view of area 10-10 of FIG. 6;

FIG. 17 is a bottom plan view of the first strap ready to be installed;

FIG. 18 is a foot end elevation view of the mattress being lifted; and,

FIG. 19 is a bottom plan view of the first strap slid underneath the mattress and connected.

DETAILED DESCRIPTION OF THE INVENTION

Figure 1:
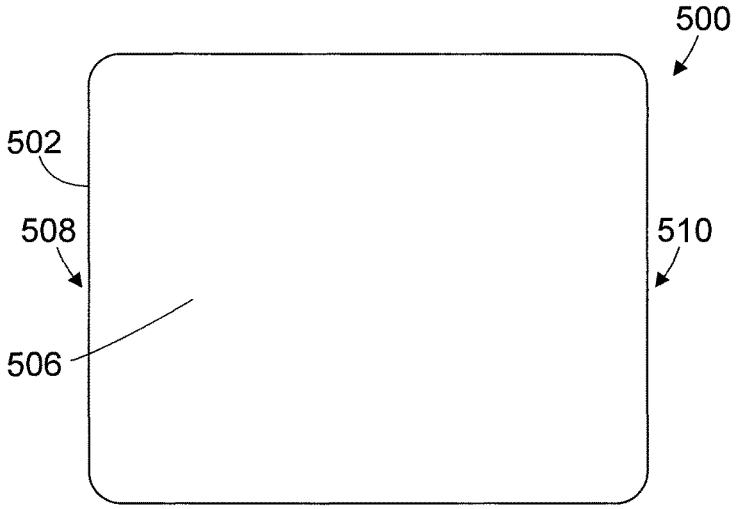
Fig. 1 PRIOR ART
FIG. 1 is a top plan view of a prior art bed which includes a mattress, a box spring, and a bottom sheet disposed on the mattress.
Figure 2:
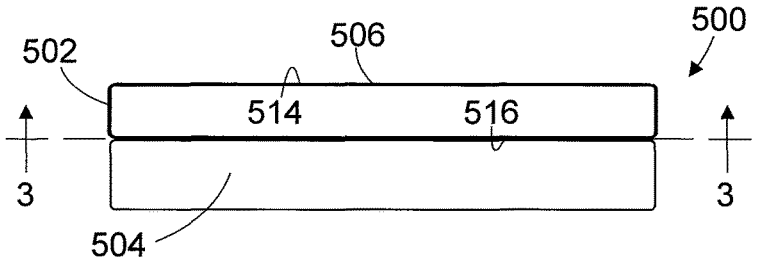
Fig. 2 PRIOR ART
FIG. 2 is side elevation view of the prior art bed.
Figure 3:
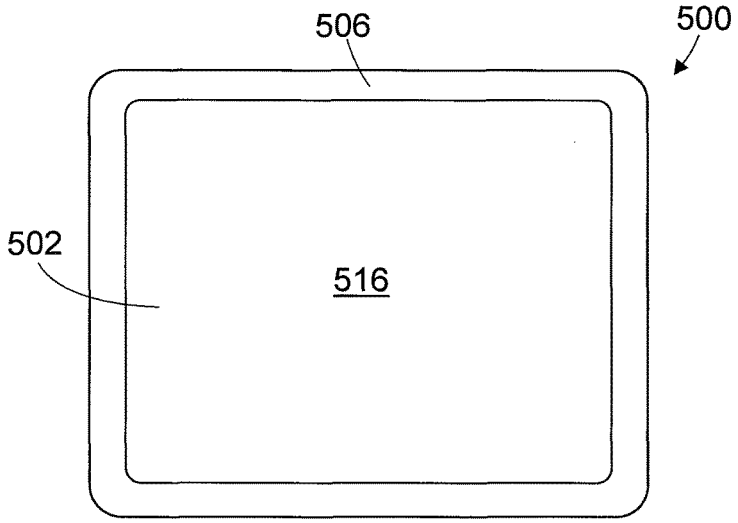
Fig. 3 PRIOR ART
FIG. 3 is a bottom plan view of the mattress and bottom sheet along line 3-3 of FIG. 2.

Referring initially to FIGS. 1-3, there are illustrated top plan, side elevation, and bottom plan views respectively of a prior art bed 500 which includes a mattress 502, a box spring 504 and a conventional bottom sheet 506 disposed on the mattress 502. Conventional bottom sheet 506, such as the shown fitted sheet, is fitted over and around mattress 502 in the usual manner with the edges of the bottom sheet 506 pulled around the edges of the mattress 502. Mattress 502 has a head portion 508 and an opposite foot portion 510. Mattress 502 includes a top surface 514 and an opposite bottom surface 516. The conventional bottom sheet 506 could also be a flat sheet which is tucked under mattress 502. The illustrated bed 500 is rectangular, however it may be appreciated that other shapes such as circular are also possible.

Figure 4:
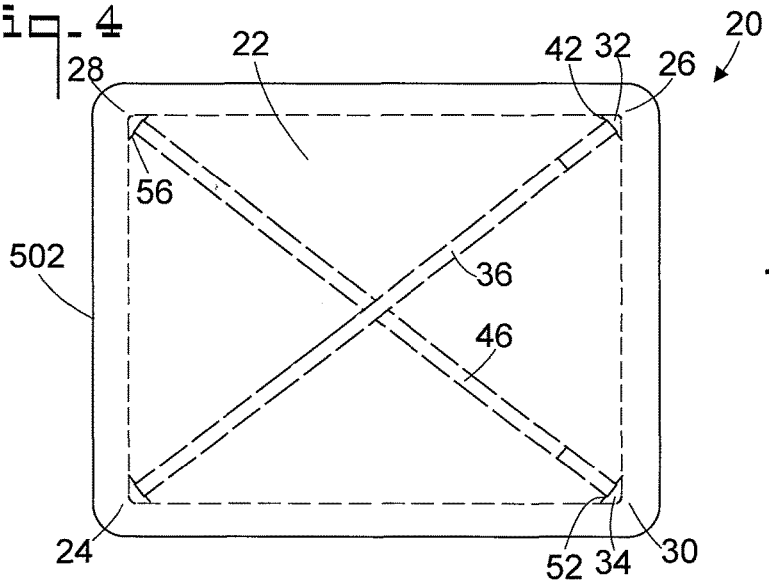
FIG. 4 is a top plan view of the mattress and box spring with a system for securing bedclothes installed.
Figure 5:
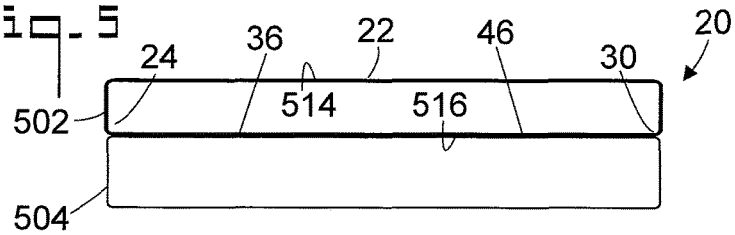
FIG. 5 is a side elevation view of FIG. 4.
Figure 6:
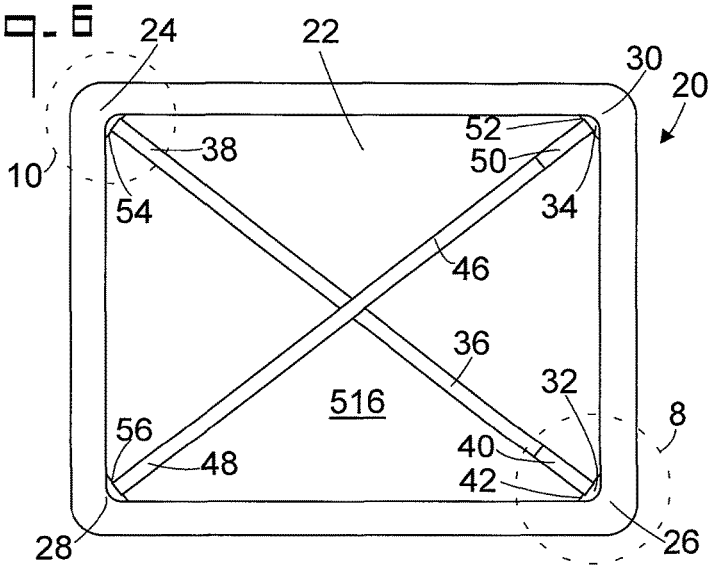
FIG. 6 is a bottom plan view of the mattress and the system for securing bedclothes.

FIG. 4 is a top plan view of mattress 502 and box spring 504 with a system for securing bedclothes 20 installed. FIG. 5 is a side elevation view of FIG. 4, and FIG. 6 is a bottom plan view of mattress 502 and system for securing bedclothes 20. FIG. 8 is an enlarged view of area 8 of FIG. 6, and FIG. 10 is an enlarged view of area 10 of FIG. 6. System for securing bedclothes 20 includes a bottom sheet 22 which is shaped and dimensioned to fit over the top surface 514 of the mattress 502 (refer to FIG. 2). Bottom sheet 22 is a modified version of conventional bottom sheet 506 of FIGS. 1-3. Bottom sheet 22 has four corners which include a first corner 24 and a diagonally opposite second corner 26, and a third corner 28 and a diagonally opposite fourth corner 30. First corner 24 and third corner 28 are disposed at the head portion 508 of mattress 502, and second corner 26 and fourth corner 30 are disposed at the foot portion 510 of mattress 502. Second corner 26 has a second corner aperture 32, and fourth corner 30 has a fourth corner aperture 34. As defined herein, the term "corner aperture" means an opening through which a strap can pass (refer to discussion below). The apertures 32 and 34 are a permanent non-removable part of bottom sheet 22, and are specifically not the result of a temporary removable attachment (such as could be made using temporary clips or clamps). Moreover, as used herein the term "permanently connected" means that items are fixedly connected together and not intended to be separated.

System for securing bedclothes 20 further includes a first strap 36 which is shaped and dimensioned to connect first corner 24 to second corner 26. First strap 36 holds first corner 24 and second corner 26 together, and as such prevents bottom sheet 22 from loosening. First strap 36 has a first end 38 which is permanently connected to first corner 24, and a second end 40 which is configured to pass through second corner aperture 32 and fold back and removably connect to itself. The fold back and connect feature is illustrated in FIGS. 8 and 9. In the shown embodiment, second corner 26 has a permanently connected second corner strap 42. Second corner strap 42 is sewn or otherwise permanently connected to the second corner 26 of bottom sheet 22, and in cooperation with the sheet material forms second corner aperture 32. Second end 40 of first strap 36 is passed through second aperture 32 and around second corner strap 42 and then folded back in the direction of the arrow and connected to itself. In the shown embodiment the connection is effected by hook-and-loop fasteners 44 which are disposed at second end 40 of first strap 36. However, it may be appreciated that other connections such as buttons, snaps, clips, clamps, hooks, magnets, etc. could also be utilized.

Similarly, system for securing bedclothes 20 further includes a second strap 46 which is shaped and dimensioned to connect third corner 28 to fourth corner 30. Second strap 46 holds third corner 28 and fourth corner 30 together, and as such prevents bottom sheet 22 from loosening. Second strap 46 has a first end 48 which is permanently connected to third corner 28, and a second end 50 which is configured to pass through fourth corner aperture 34 and fold back and connect to itself. The fold back and connect feature is the same as that illustrated for first strap 36 in FIGS. 8 and 9. In the shown embodiment, fourth corner 30 has a permanently connected fourth corner strap 52 (similar to second corner strap 42 shown in FIG. 8). Fourth corner strap 52 is sewn or otherwise permanently connected to the fourth corner 30 of bottom sheet 22, and in cooperation with the sheet material forms fourth corner aperture 34. Second end 50 of second strap 46 is passed through fourth aperture 34 around second corner strap 52 and then folded back and connected to itself. In the shown embodiment the connection is effected by hook-and-loop fasteners which are disposed at second end 50 of second strap 46. However, it may be appreciated that other connections such as buttons, snaps, clips, clamps, hooks, magnets, etc. could also be utilized. Referring specifically to FIG. 6, it is noted that bottom sheet 22 is connectable to mattress 502 so that bottom sheet 22 covers the top surface 514 of mattress 502, and second corner aperture 32, fourth corner aperture 34, first strap 36, and second strap 46 are all disposed underneath the bottom surface 516 of mattress 502 between mattress 502 and box spring 504. As such, the foot portion 510 corners of mattress 502 must be lifted to connect first strap 36 and second strap 46. In FIGS. 4-6 it is noted that first corner 24, third corner 28, second corner aperture 32, fourth corner aperture 34, first strap 36, and second strap 46 are all disposed in coplanar relationship underneath the bottom surface 516 of mattress 502. That is, the entire system for securing bedclothes 20 is disposed between mattress 502 and box spring 504 and is therefore hidden from view.

Figure 7:
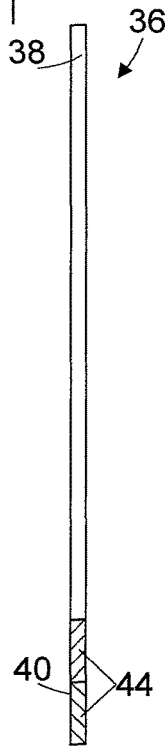
FIG. 7 is a top plan view of a first strap.

FIG. 7 is a top plan view of first strap 36 with second strap 46 having the same structure. Shown are first end 38 which is permanently connected to first corner 24 of bottom sheet 22 (refer to FIG. 6), second end 40 with hook-and-loop fasteners in the shown embodiment. First strap 36 and second strap 46 are made from a friction-reducing material (such as polypropylene or sailboat sail material). This is so first strap 36 and second strap 46 can be easily slid between mattress 502 and box spring 504 to effect the diagonal corner connections. It is noted that first strap 36 and second strap 46 are each single straps. That is, first strap 36 and second strap 46 are each one continuous strap and do not include multiple strap segments.

FIG. 9 is a view along line 9-9 of FIG. 8 which shows how second end 40 of first strap 36 is passed through second corner aperture 32, folded back around second corner strap 42, and connected to itself using hook-and-loop fasteners 44. Also shown are mattress 502 and bottom sheet 22.

FIG. 10 is an enlarged view of area 10-10 of FIG. 6. Also referring to FIG. 6, In the shown embodiment, first corner 24 has a permanently connected first corner strap 54, and third corner 28 has a permanently connected third corner strap 56. First end 38 of first strap 36 is permanently connected (such as sewn) to first corner strap 54. Similarly, first end 48 of second strap 46 is permanently connected to third corner strap 56.

Figure 11:
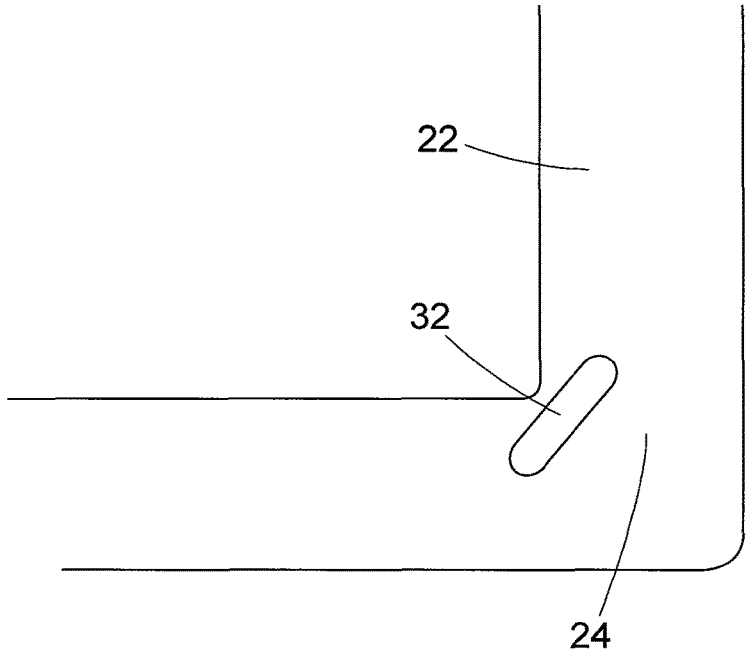
FIG. 11 is an enlarged view as in FIG. 8 showing a different embodiment aperture.

FIG. 11 is an enlarged view as in FIG. 8 showing a different embodiment corner aperture. Also referring to FIG. 6, in this embodiment second corner aperture 32 and fourth corner aperture 34 each include an opening in bottom sheet 22. That is, apertures 32 and 34 are not formed by adding corner straps 42 and 52 respectively, but rather are formed by a opening such as a hole or slit in the fabric of bottom sheet 22. The boundary of the opening can be reinforced such as with stitching to prevent tearing. In the shown embodiment, apertures 32 and 34 are each a single opening.

Figure 12:
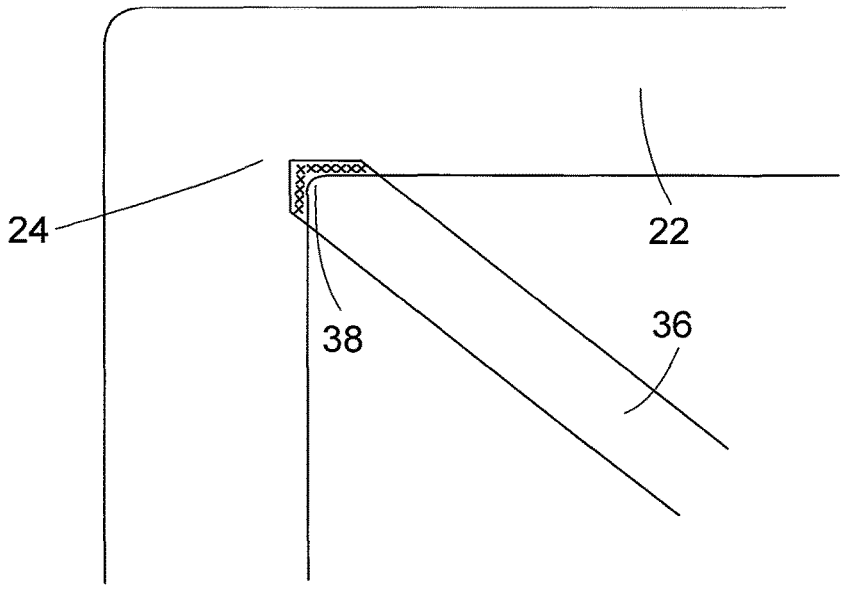
FIG. 12 is an enlarged view as in FIG. 10 showing a different connection of the first strap to the bottom sheet.

FIG. 12 is an enlarged view as in FIG. 10 showing a different connection of first strap 36 to bottom sheet 22. Also referring to FIG. 6, in this embodiment, first end 38 of first strap 36 is directly sewn to first corner 24. Similarly, first end 48 of second strap 46 is directly sewn to third corner 28.

Figure 13:
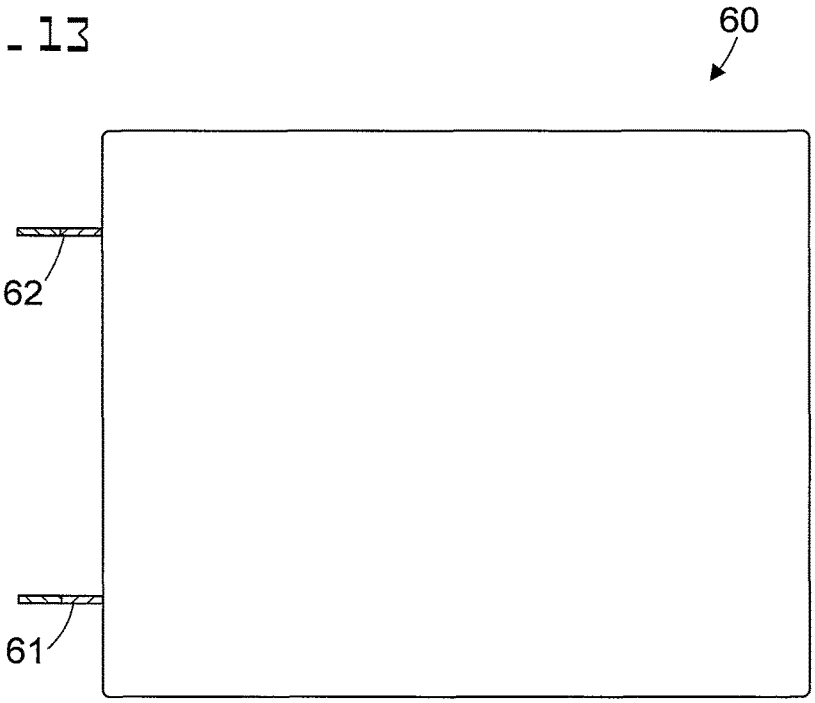
FIG. 13 is a bottom plan view of a top sheet.
Figure 14:
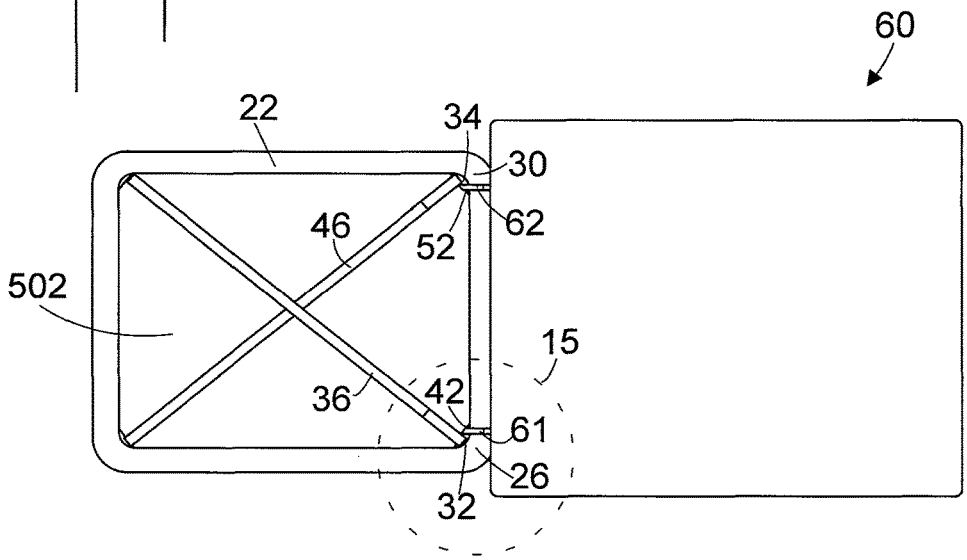
FIG. 14 is a reduced bottom plan view of the top sheet, the mattress, and the bottom sheet.
Figure 15:
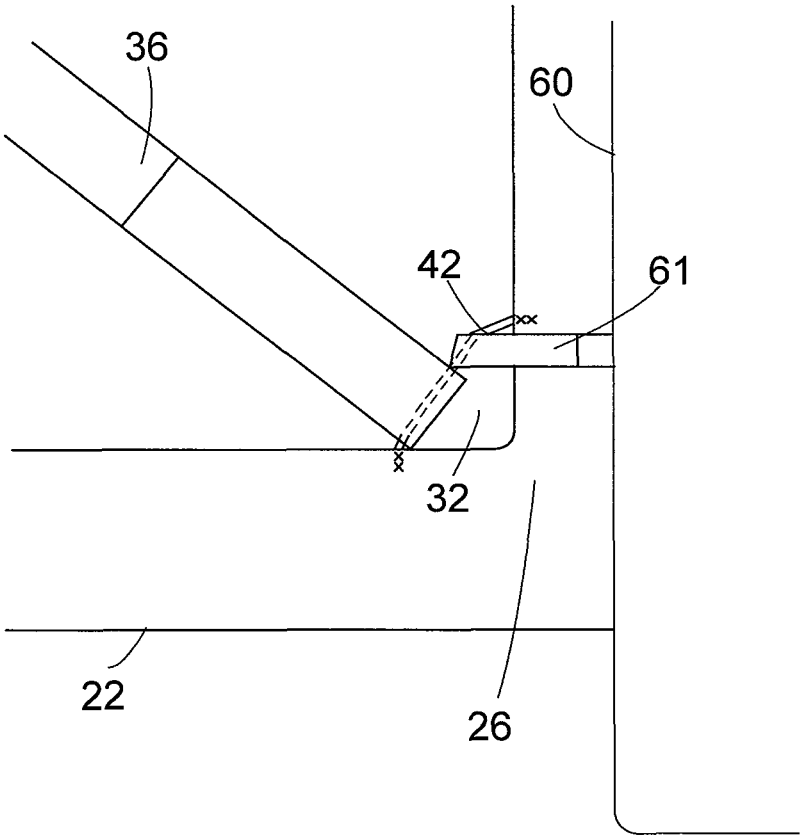
FIG. 15 is an enlarged view of area 15 of FIG. 14.
Figure 16:
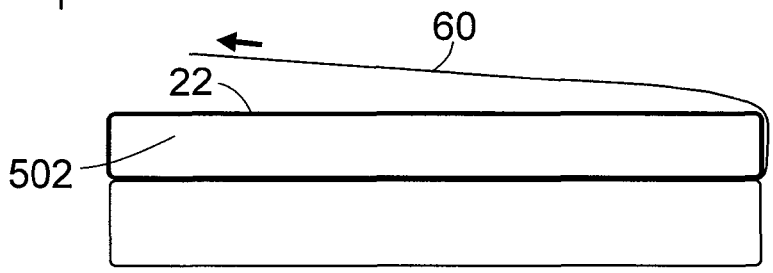
FIG. 16 is a side elevation view of the top sheet being pulled up.

FIG. 13 is a bottom plan view of a top sheet 60, FIG. 14 is a reduced bottom plan view of top sheet 60, mattress 502, and bottom sheet 22, FIG. 15 is an enlarged view of area 15 of FIG. 14, and FIG. 16 is a side elevation view of top sheet 60 being pulled up to cover bottom sheet 22. Top sheet 60 has a permanently connected first sheet strap 61 which is spaced apart from a permanently connected second sheet strap 62. As with first 36 and second 46 straps, first sheet strap 61 is configured to pass through second corner aperture 32 and fold back and connect to itself, and second sheet strap 62 is configured to pass through fourth corner aperture 34 and fold back and connect to itself. In the shown embodiment, the ends of first sheet strap 61 and second sheet strap 62 each include hook-and-loop fasteners to effect the folded back connection. By connecting top sheet 60 to bottom sheet 22 and to mattress 502, top sheet 60 is prevented from coming loose.

FIG. 17 is a bottom plan view of first strap 36 ready to be installed, FIG. 18 is a foot end elevation view of mattress 502 being lifted, and FIG. 19 is a bottom plan view of first strap 36 slid underneath mattress 502 and connected. These FIGS. illustrate a method for securing bedclothes. Also referring to FIGS. 1-12, the method includes:

(a) providing a mattress 502 having a top surface 514 and an opposite bottom surface 516;

(b) providing a bottom sheet 22 which is shaped and dimensioned to fit over the top surface 514 of the mattress 502, the bottom sheet 22 having four corners, the four corners including a first corner 24 and a diagonally opposite second corner 26, and a third corner 28 and a diagonally opposite fourth corner 30, the second corner 26 having a second corner aperture 32, and the fourth corner having a fourth corner aperture 34;

(c) providing a first strap 36 which is shaped and dimensioned to connect the first corner 24 to the second corner 26, the first strap 36 having a first end 38 which is permanently connected to the first corner 24, and a second end 40 which is configured to pass through the second corner aperture 32 and fold back and connect to itself;

(d) providing a second strap 46 which is shaped and dimensioned to connect the third corner 28 to the fourth corner 30, the second strap 46 having a first end 48 which is permanently connected to the third corner 28, and a second end 50 which is configured to pass through the fourth corner aperture 34 and fold back and connect to itself;

(e) connecting the bottom sheet 22 to the mattress 502;

(f) sliding the first strap 36 underneath the bottom surface 516 of the mattress 502 so that the second end 38 is adjacent the second corner 26;

(g) lifting the mattress 502 and passing the second end 40 of the first strap 36 through the second corner aperture 32 so that it folds back and connects to itself;

(h) sliding the second strap 46 underneath the bottom surface 516 of the mattress 502 so that it is adjacent the fourth corner 30;

(i) lifting the mattress 502 and passing the second end 50 of the second strap 46 through the fourth corner aperture 34 so that it folds back and connects to itself; and, after (i), lowering mattress 502 so that the first corner 24, the third corner 28, the second corner aperture 32, the fourth corner aperture 34, the first strap 36, and the second strap 46 are all disposed in coplanar relationship underneath the bottom surface 516 of the mattress 502.

Note: As appropriate the order of performance of the above cited method steps can be changed.

The embodiments of the system for securing bedclothes to a mattress and method described herein are exemplary and numerous modifications, combinations, variations, and rearrangements can be readily envisioned to achieve an equivalent result, all of which are intended to be embraced within the scope of the appended claims. Further, nothing in the above-provided discussions of the system and method should be construed as limiting the invention to a particular embodiment or combination of embodiments. The scope of the invention is defined by the appended claims.

I claim:

1. A system for securing bedclothes to a mattress having a top surface and an opposite bottom surface, the system comprising:

a bottom sheet which is shaped and dimensioned to fit over the top surface of the mattress, said bottom sheet having four corners, said four corners including a first corner and a diagonally opposite second corner, and a third corner and a diagonally opposite fourth corner;

said second corner having a second corner aperture, and said fourth corner having a fourth corner aperture;

a first strap which is shaped and dimensioned to connect said first corner to said second corner;

said first strap having a first end which is permanently connected to said first corner, and a second end which is configured to pass through said second corner aperture and fold back and connect to itself;

a second strap which is shaped and dimensioned to connect said third corner to said fourth corner; and, said second strap having a first end which is permanently connected to said third corner, and a second end which is configured to pass through said fourth corner aperture and fold back and connect to itself.

2. The system for securing bedclothes according to claim 1, further including:

said second corner aperture and said fourth corner aperture each including a single opening in said bottom sheet.

3. The system for securing bedclothes according to claim 1, further including:

said first corner having a permanently connected first corner strap, and said third corner having a permanently connected third corner strap;

said first end of said first strap is permanently connected to said first corner strap; and, said first end of said second strap is permanently connected to said third corner strap.

4. The system for securing bedclothes according to claim 3, further including:

said first end of said first strap being sewn to said first corner strap; and, said first end of said second strap being sewn to said third corner strap.

5. The system for securing bedclothes according to claim 1, further including:

said first end of said first strap being directly sewn to said first corner of said bottom sheet; and, said first end of said second strap being directly sewn to said third corner of said bottom sheet.

6. The system for securing bedclothes according to claim 1, further including:

said bottom sheet is connectable to the mattress so that said bottom sheet covers the top surface of the mattress, and said second corner aperture, said fourth corner aperture, said first strap, and said second strap are all disposed underneath the bottom surface of the mattress.

7. The system for securing bedclothes according to claim 6, further including:

said first corner, said third corner, said second corner aperture, said fourth corner aperture, said first strap, and said second strap all disposed in coplanar relationship underneath the bottom surface of the mattress.

8. The system for securing bedclothes according to claim 1, further including:

said first corner having a permanently connected first corner strap, and said third corner having a permanently connected third corner strap;

said first end of said first strap is permanently connected to said first corner strap;

said first end of said second strap is permanently connected to said third corner strap;

said first end of said first strap being sewn to said first corner strap;

said first end of said second strap being sewn to said third corner strap;

said bottom sheet is connectable to the mattress so that said bottom sheet covers the top surface of the mattress, and said second corner aperture, said fourth corner aperture, said first strap, and said second strap are all disposed underneath the bottom surface of the mattress; and, said first corner, said third corner, said second corner aperture, said fourth corner aperture, said first strap, and said second strap all disposed in coplanar relationship underneath the bottom surface of the mattress.

9. A method for securing bedclothes, comprising:

(a) providing a mattress having a top surface and an opposite bottom surface;

(b) providing a bottom sheet which is shaped and dimensioned to fit over said top surface of said mattress, said bottom sheet having four corners, said four corners including a first corner and a diagonally opposite second corner, and a third corner and a diagonally opposite fourth corner, said second corner having a second corner aperture, and said fourth corner having a fourth corner aperture;

(c) providing a first strap which is shaped and dimensioned to connect said first corner to said second corner, said first strap having a first end which is permanently connected to said first corner, and a second end which is configured to pass through said second corner aperture and fold back and connect to itself;

(d) providing a second strap which is shaped and dimensioned to connect said third corner to said fourth corner, said second strap having a first end which is permanently connected to said third corner, and a second end which is configured to pass through said fourth corner aperture and fold back and connect to itself;

(e) connecting said bottom sheet to said mattress;

(f) sliding said first strap underneath said bottom surface of said mattress so that said second end is adjacent said second corner;

(g) lifting said mattress and passing said second end of said first strap through said second corner aperture so that it folds back and connects to itself;

(h) sliding said second strap underneath said bottom surface of said mattress so that it is adjacent said fourth corner;

(i) lifting said mattress and passing said second end of said second strap through said fourth corner aperture so that it folds back and connects to itself; and, after (i), lowering said mattress so that said first corner, said third corner, said second corner aperture, said fourth corner aperture, said first strap, and said second strap all disposed in coplanar relationship underneath the bottom surface of the mattress.

* * * * *